US007410161B2

(12) United States Patent
Yamamoto

(10) Patent No.: US 7,410,161 B2
(45) Date of Patent: Aug. 12, 2008

(54) SHEET FEEDING APPARATUS, AND IMAGE FORMING APPARATUS AND IMAGE READING APPARATUS RESPECTIVELY EQUIPPED WITH SHEET FEEDING APPARATUS

(75) Inventor: Tatsuyuki Yamamoto, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 540 days.

(21) Appl. No.: 11/044,290

(22) Filed: Jan. 28, 2005

(65) Prior Publication Data

US 2005/0189699 A1 Sep. 1, 2005

(30) Foreign Application Priority Data

Feb. 4, 2004 (JP) ..... 2004-028279

(51) Int. Cl.
*B65H 3/52* (2006.01)

(52) U.S. Cl. ..... 271/124; 271/121; 271/113

(58) Field of Classification Search ..... 271/113, 271/9.01, 10.11, 121, 124
See application file for complete search history.

(56) References Cited

U.S. PATENT DOCUMENTS

| | | | | |
|---|---|---|---|---|
| 5,504,565 | A | 4/1996 | Tomiki et al. | 355/274 |
| 5,587,780 | A | 12/1996 | Sugino et al. | 355/274 |
| 5,915,146 | A | 6/1999 | Kusaka et al. | 399/68 |
| 5,915,684 | A * | 6/1999 | Nakagawa et al. | 271/110 |
| 5,918,876 | A * | 7/1999 | Maruyama et al. | 271/228 |
| 6,017,031 | A * | 1/2000 | Oosawa et al. | 271/121 |
| 6,392,763 | B1 * | 5/2002 | Nishinohara et al. | 358/496 |
| 6,991,227 | B2 * | 1/2006 | Kim | 271/10.12 |
| 2002/0008343 | A1 * | 1/2002 | Inoue et al. | 271/10.11 |
| 2003/0184000 | A1 | 10/2003 | Kim | 271/10.11 |
| 2004/0155397 | A1 * | 8/2004 | Gaarder et al. | 271/10.11 |
| 2004/0188918 | A1 * | 9/2004 | Morimoto et al. | 271/121 |

FOREIGN PATENT DOCUMENTS

| | | |
|---|---|---|
| JP | 58207228 | * 12/1983 |
| JP | 9-58891 | 3/1997 |
| JP | 9-240862 | 9/1997 |
| JP | 2001-22137 | 1/2001 |

OTHER PUBLICATIONS

Official Letter/Search Report.

* cited by examiner

*Primary Examiner*—Patrick Mackey
*Assistant Examiner*—Patrick D Cicchino
(74) *Attorney, Agent, or Firm*—Fitzpatrick, Cella, Harper & Scinto

(57) ABSTRACT

A sheet feeding apparatus comprises a sheet stacking portion for stacking sheets thereon, a sheet feeding rotating member for feeding the sheet stacked on the sheet stacking portion, a stopper for regulating the sheet stacked on the sheet stacking portion, and a rotatable gear adapted to hold the stopper at the regulating position of regulating the sheet stacked on the sheet stacking portion, by engaging with the stopper. In this construction, the engagement of the gear and the stopper is released when the gear is rotated.

10 Claims, 13 Drawing Sheets

SHEET FEEDING APPARATUS, AND IMAGE FORMING APPARATUS AND IMAGE READING APPARATUS RESPECTIVELY EQUIPPED WITH SHEET FEEDING APPARATUS

BACKGROUND OF THE INVENTION

1. Field of the Invention

The present invention relates to a sheet feeding apparatus, and an image forming apparatus and an image reading apparatus which are respectively equipped with the sheet feeding apparatus.

2. Related Background Art

Conventionally, an image forming apparatus such as a copying machine, a printer, a facsimile machine or the like, or an image reading apparatus such as a scanner or the like is equipped with a sheet feeding apparatus which feeds sheets to an image forming portion or an image reading portion. More specifically, in the sheet feeding apparatus like this, for example, the sheets stacked on a sheet stacking portion are fed to a sheet feeding means, the fed sheets are then separated one by one by a separating portion consisting of a separating roller and a separating pad, and the separated sheet is further conveyed to the image forming section or the image reading section.

Incidentally, as the conventional sheet feeding apparatus like this, there is an apparatus which is equipped with a stopper member rotating on, e.g., the upper point of a sheet conveying path so as to stop the sheets at a predetermined position when the sheets are stacked on the sheet staking portion. Thus, in this apparatus, the sheets are stacked when the stopper member is at the position to block up the sheet conveying path so that the stacked sheets abut against the stopper member, whereby the sheets are stopped at the predetermined position.

Here, in the case where the stopper member like this is provided, it is necessary to shift the stopper member to its initial position after ending the sheet conveying. In this context, as the construction for controlling the position of the stopper member, a construction for controlling the position of the stopper member without using a solenoid and an electromagnetic clutch being electrical actuators, and a mechanical spring clutch has been proposed (see Japanese Patent Application Laid-Open Nos. 2001-022137, H09-240862 and H09-058891).

In the above construction, for example, a driving source of a sheet conveying means is used as the driving source for controlling the position of the stopper member, and driving to the stopper member is transmitted through the sheet conveying means, whereby it is possible to prevent from transmitting excessive driving force. Thus, the above construction achieves the stopper member position controlling without using the electrical actuator and the spring clutch. Consequently, by not using the electrical actuator and the spring clutch as above, the above construction achieves space saving, cost reduction, and load reduction to a power supply substrate. Moreover, the above construction achieves achieve the high-reliability stopper member position controlling with extremely less number of parts.

However, in the conventional sheet feeding apparatus and the image forming and reading apparatuses respectively equipped with the conventional sheet feeding apparatus, after discharging all the sheets and before inserting a next sheet, it is necessary to execute an initialization operation to return the stopper member to its initial position preceding the stacking of the sheets so as to prepare a control function for the sheet leading edges. Here, to return the stopper member to its initial position, it is necessary to reverse a motor.

Incidentally, in Japanese Patent Application Laid-Open No. 2001-022137, when the stopper member is returned to its initial position and fixed, a large load is applied to the engaging arm portion of the stopper member, whereby it is necessary to sufficiently enlarge the stopper member (i.e., the engaging arm portion thereof) to maintain the intensity thereof. Moreover, there is a problem that the cost of the motor increases because large torque is necessary for the motor.

Further, in Japanese Patent Application Laid-Open No. H09-240862, it is necessary to surely reverse the motor as many as a predetermined rotation number to return the stopper member to its initial position. For this reason, there is a problem that the above controlling for the stopper member position is not applicable to the apparatus in which reverse rotation of the motor is executed for another use, that is, the use other than the return of the stopper member to its initial position.

Furthermore, in Japanese Patent Application Laid-Open No. H09-058891, the initial position of the stopper member is recognized by a sensor of primarily detecting whether an original (sheet) exists. However, in such a construction, turning on and off of the sensor are repeated intermittently even after a last original passed the stopper member, whereby interrupt processes of software frequently occur. Thus, the overall process might become heavy. Moreover, it is likely that the sensor is turned on because the position of the stopper member shifts due to opening and closing of an original guide. In this case, there is a problem that it is difficult on software to discriminate whether the original has been inserted or the stopper member is not on its initial position.

SUMMARY OF THE INVENTION

The present invention has been made in consideration of such present situations, and an object thereof is to provide a sheet feeding apparatus which can achieve space saving and cost reduction, and, when sheets are stacked thereon, can surely stop the sheets at a predetermined position, and to further provide an image forming apparatus and an image reading apparatus each of which is equipped with the sheet feeding apparatus.

The present invention is characterized by comprising a sheet stacking portion for stacking sheets thereon, a sheet feeding rotating member adapted to feed the sheet stacked on the sheet stacking portion, a stopper adapted to regulate the sheets stacked on the sheet stacking portion, and a rotatable gear adapted to hold the stopper at a regulating position of regulating the sheets stacked on said sheet stacking portion, by engaging with the stopper, and is further characterized in that the engagement of the gear and the stopper portion is released when the gear is rotated.

DETAILED DESCRIPTION OF THE PREFERRED EMBODIMENTS

Hereinafter, the preferred embodiments of the present invention will be explained in detail with reference to the accompanying drawings.

Figure 1:
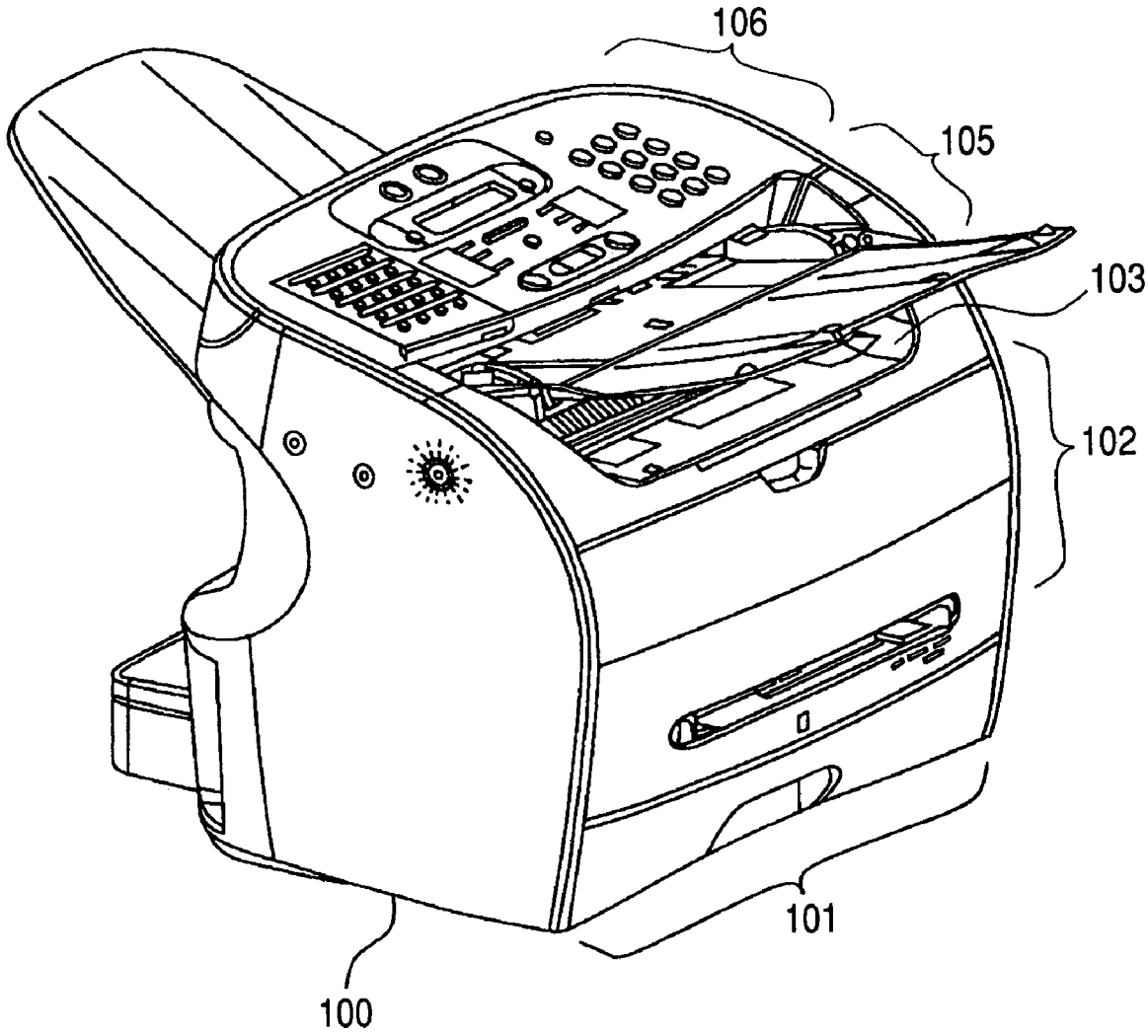
FIG. 1 is an exterior perspective diagram showing an MFP (multiple function peripheral) being an example of an image forming apparatus equipped with a sheet feeding apparatus according to the present invention.
Figure 2:
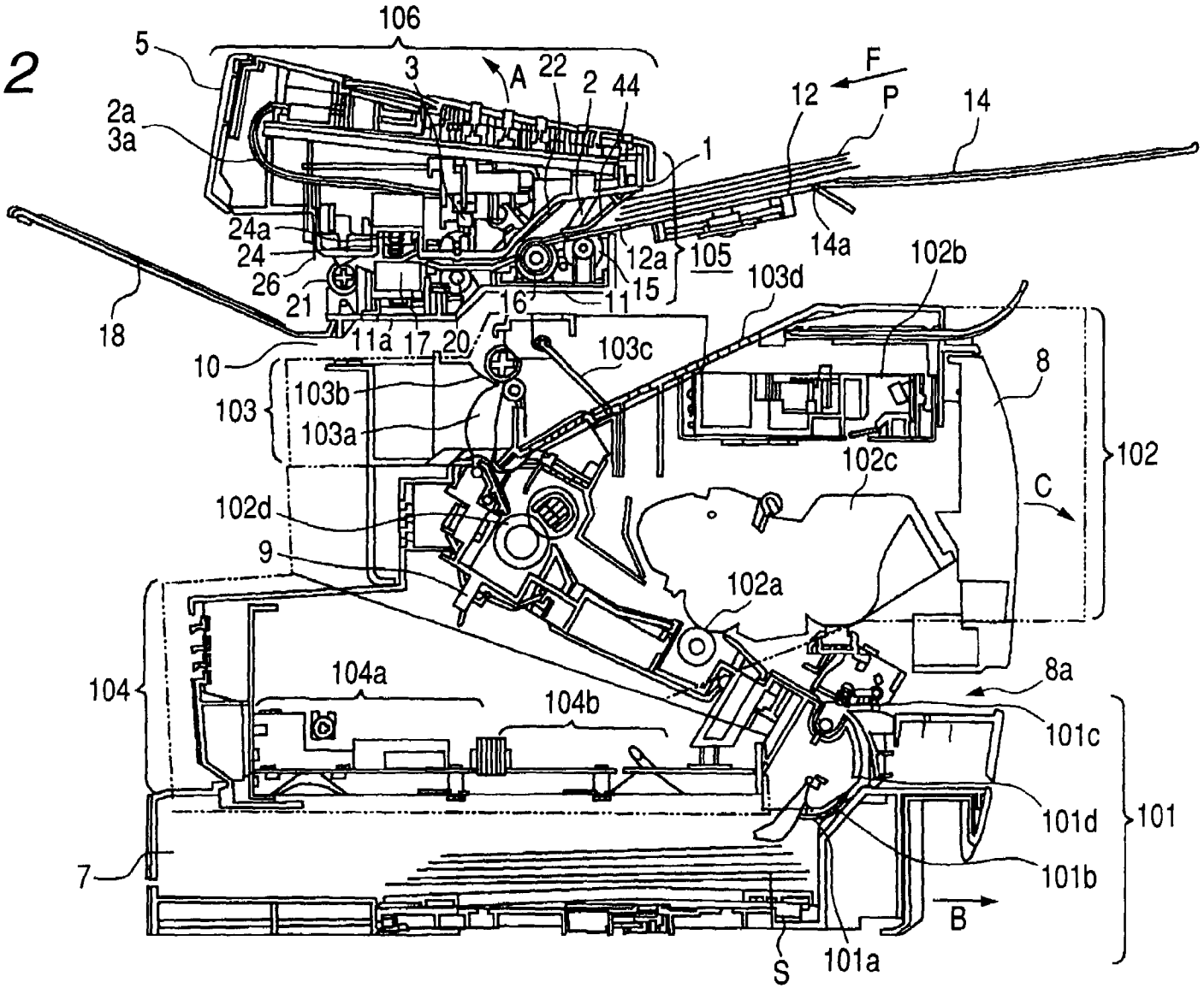
FIG. 2 is a cross section diagram of the MFP.

FIG. 1 is an exterior perspective diagram showing an MFP (multiple function peripheral) being an example of an image forming apparatus equipped with a sheet feeding apparatus according to the present invention, and FIG. 2 is a cross section diagram of the MFP.

The MFP has four functions, i.e., a copy function, a facsimile function, a printer function for acting as a computer peripheral device, and an image scanner function for also acting as the computer peripheral device. Besides, the MFP consists of an apparatus main body 100, a recording sheet feeding portion 101, an electrophotographic image forming section 102, an original reading section 105, and an operation portion 106.

Here, the recording sheet feeding portion 101 separates and feeds one by one recording sheets S stacked on a recording sheet cassette 7 by a separating means consisting of a not-shown separating pawl and a friction pad 101*b*, and then supplies the recording sheet S to the image forming section 102 through a pair of registration rollers (hereinafter called registration roller pair) 101*c*.

Incidentally, the recording sheet S is a paper, a resin sheet, and another material, and can use electrostatic dry recording toner as transferable toner. Besides, the recording sheet cassette 7 which can hold 150 standard-sized plain sheets (papers) can be drawn from the apparatus main body 100 in the near-side direction (i.e., direction B in FIG. 2). Thus, after the recording sheet cassette 7 was drawn from the apparatus main body 100, the recording sheets S can be exchanged or refilled.

Moreover, in FIG. 2, numeral 8 denotes a front cover, and only one recording sheet can be inserted through an opening portion 8*a* provided on the front cover 8. Then, the inserted recording sheet is interflowed by a sheet-passing bent path 101*d* and the registration roller pair 101*c* connected to the recording sheet cassette 7, and the interflowed recording sheet is further conveyed to a downstream transferring portion 102*a*.

The image forming section 102 forms an image in an electrophotographic manner on the recording sheet S supplied from the recording sheet feeding portion 101, in response to an image signal transmitted from another apparatus, an image signal transmitted from the later-described original reading section 105 or data output from a computer and the like. The image forming section 102 is held within a main body frame 9, and consists of a laser scanner 102*b*, a toner-incorporated cartridge 102*c*, the transferring portion 102*a*, a fixing portion 102*d* and a discharging portion 103.

Figure 3:
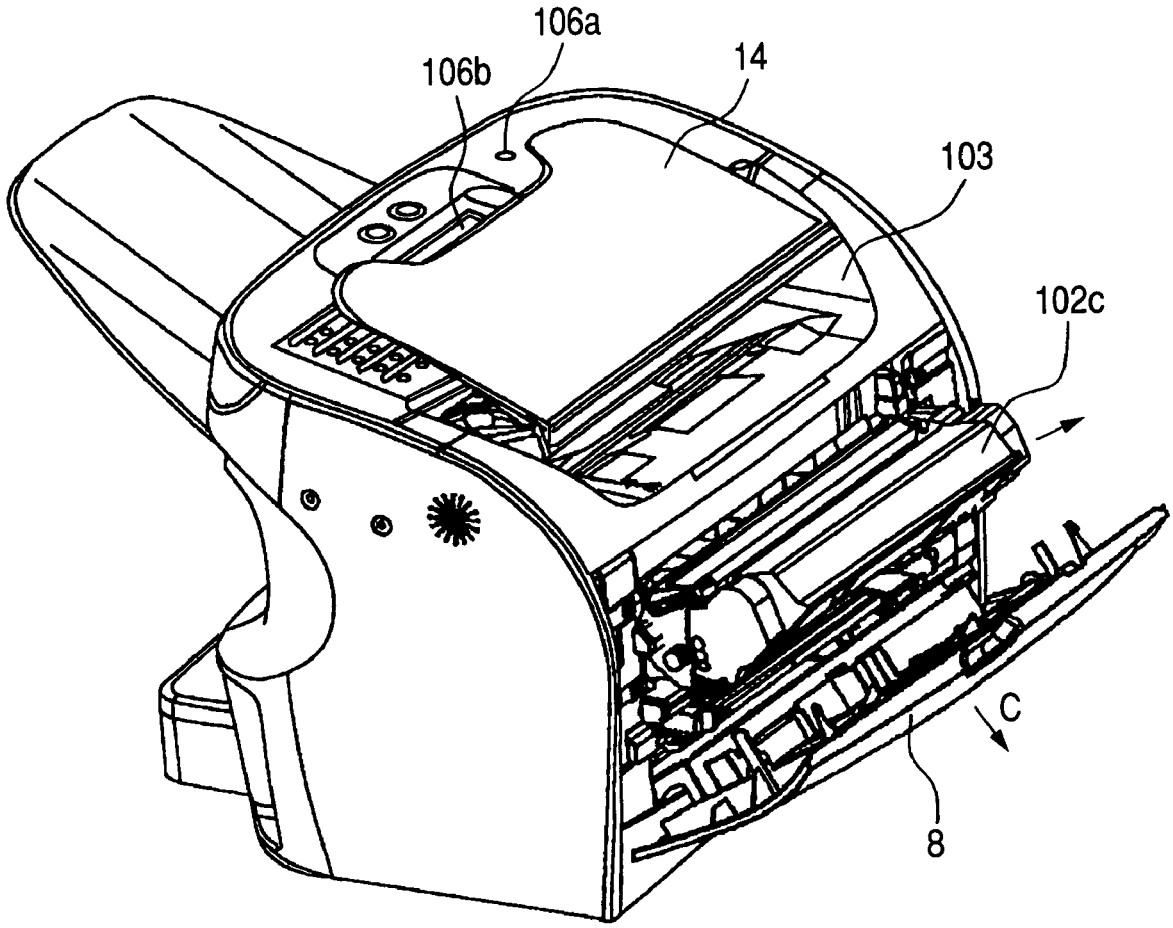
FIG. 3 is a cross section diagram showing the state that the front cover of the MFP is opened.

Incidentally, the toner-incorporated cartridge 102*c* can be inserted into and removed from the opening portion which is opened by rotating the front cover 8 of the apparatus main body 100 in the direction indicated by an arrow C as shown in FIG. 3. Thus, when the toner-incorporated cartridge 102*c* is loaded into the apparatus main body 100 and the front cover 8 is then closed, a not-shown recording portion driving means and the coupling of the rotating shaft of the toner-incorporated cartridge 102*c* are connected with each other, whereby driving is transmitted.

Moreover, the discharging portion 103 consists of a U-turn path 103*a*, a pair of discharging rollers (hereinafter called discharging roller pair) 103*b*, a recording sheet excessive stacking detecting portion 103*c*, and a discharging tray 103*d*. Further, a heat discharging duct 10 is provided between the discharging portion 103 and the original reading section 105, whereby heat from the fixing portion 102*d* is discharged forward and backward of the apparatus main body 100.

The original reading section 105 converts reflection light obtained by illuminating light onto an original P into an electrical signal, executes a predetermined image process to the acquired electrical signal, and then transmits the processed signal to another apparatus or an own recording controlling portion 104. Thus, the original feeding portion (sheet feeding device) is provided to feed an original being a sheet to the image reading section.

In addition, in FIG. 2, numeral 11 denotes a resin frame which supports the image reading section 105, and a bottom face 11*a* of the frame 11 also acts as the heat discharging duct together with the discharging portion 103. Here, it should be noted that a hole is not made on the bottom face 11*a* at all so that water vapor generated from the recording sheet S does not penetrate into the image reading portion at the fixing portion 102*d*.

Numeral 12 denotes an original tray(sheet tray) which is equipped with original width regulating plates 13*a* and 13*b*, and the original tray 12 acts as the sheet stacking portion. Numeral 14 denotes an extension tray which is rotatable based on a fulcrum 14*a*, numeral 15 denotes a pre-feeding roller, numeral 16 denotes a separating roller, numeral 18 denotes a detachable original discharging tray, numeral 17 denotes a photoelectric converting element which acts as the image reading portion, numeral 20 denotes a conveying roller, and numeral 21 denotes a discharging roller. Incidentally, in the present embodiment, a CIS (Contact Image Sensor) is used as the photoelectric converting element 17 to achieve downsizing.

Moreover, numeral 1 denotes an upper original guide in which an original presence/absence sensor 2 and an original edge sensor 3 each consisting of a photointerruptor and a resin actuator are provided. Numerals 2*a* and 3*a* denote wiring harnesses of the respective sensors 2 and 3. The respective wiring harnesses 2*a* and 3*a* are led from the backside of the upper original guide 1 to the outside, and then connected to a connector 4*a* provided on an operation portion substrate 4 through a wiring harness holding portion 1*a* shown in FIG. 4.

The reason why the wiring harnesses 2*a* and 3*a* of the respective sensors 2 and 3 are once led outside is to improve assembling performance. In other words, to dispose and connect the wiring harnesses 2*a* and 3*a* within the area of the operation portion substrate 4, it is necessary to lengthen these harnesses unnecessarily for wiring work and it is also necessary to provide a hole by which these harnesses and assembling tools are penetrated through the operation portion substrate 4.

However, in the above former case, the redundant wiring harnesses 2*a* and 3*a* come into contact with the element legs, whereby there is a fear that these harnesses are damaged and/or short-circuited. In addition, in the above latter case, the unnecessary hole exists on the operation portion substrate 4, whereby there is a fear that a degree of freedom of the layout of an operation key, which should attach importance to operability, is obstructed. Thus, in the present embodiment, to solve such problems, the wiring harnesses 2*a* and 3*a* are led outside the projection plane of the operation portion substrate 4, the operation portion substrate 4 and an operation portion cover 5 shown in FIG. 2 are assembled respectively, the assembled substrate and cover are attached to the upper original guide 1, and then the wiring harnesses 2*a* and 3*a* are connected to the operation portion substrate 4.

Figure 5:
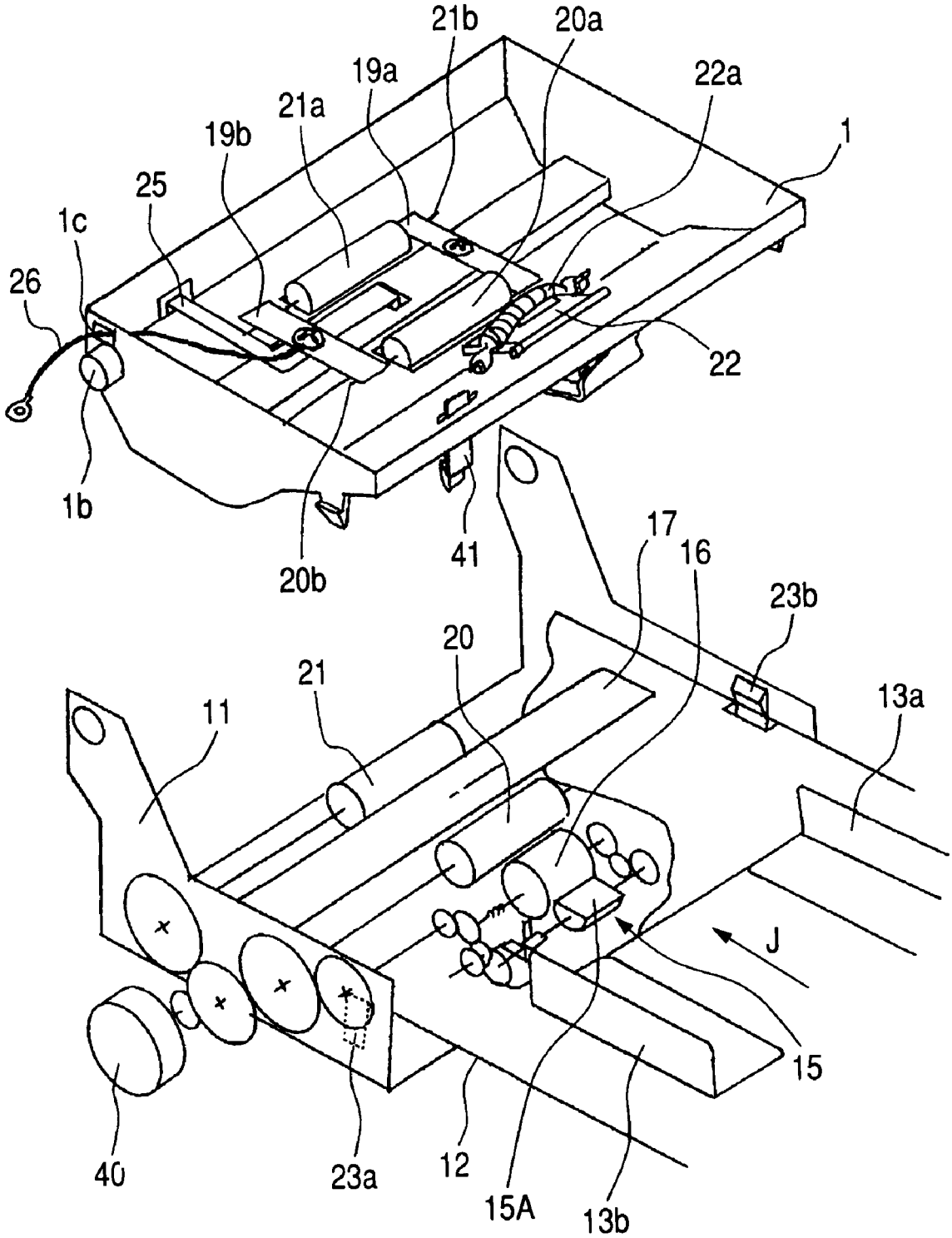
FIG. 5 is a diagram for explaining the construction of an original reading portion of the MFP.

Moreover, as shown in FIG. 5, in the original guide 1, backup rollers 20*a* and 21*a* which are pressure contacted with the conveying roller 20 and the discharging roller 21 respectively by blade springs 19*a* and 19*b*, and a friction pad 22 which is urged toward the separating roller 16 by a spring 22*a* are provided. Incidentally, numerals 23*a* and 23*b* respectively denote locking portions, and the upper original guide 1 is resiliently engaged with the resin frame 11 by means of the locking portions 23*a* and 23*b*.

Figure 6:
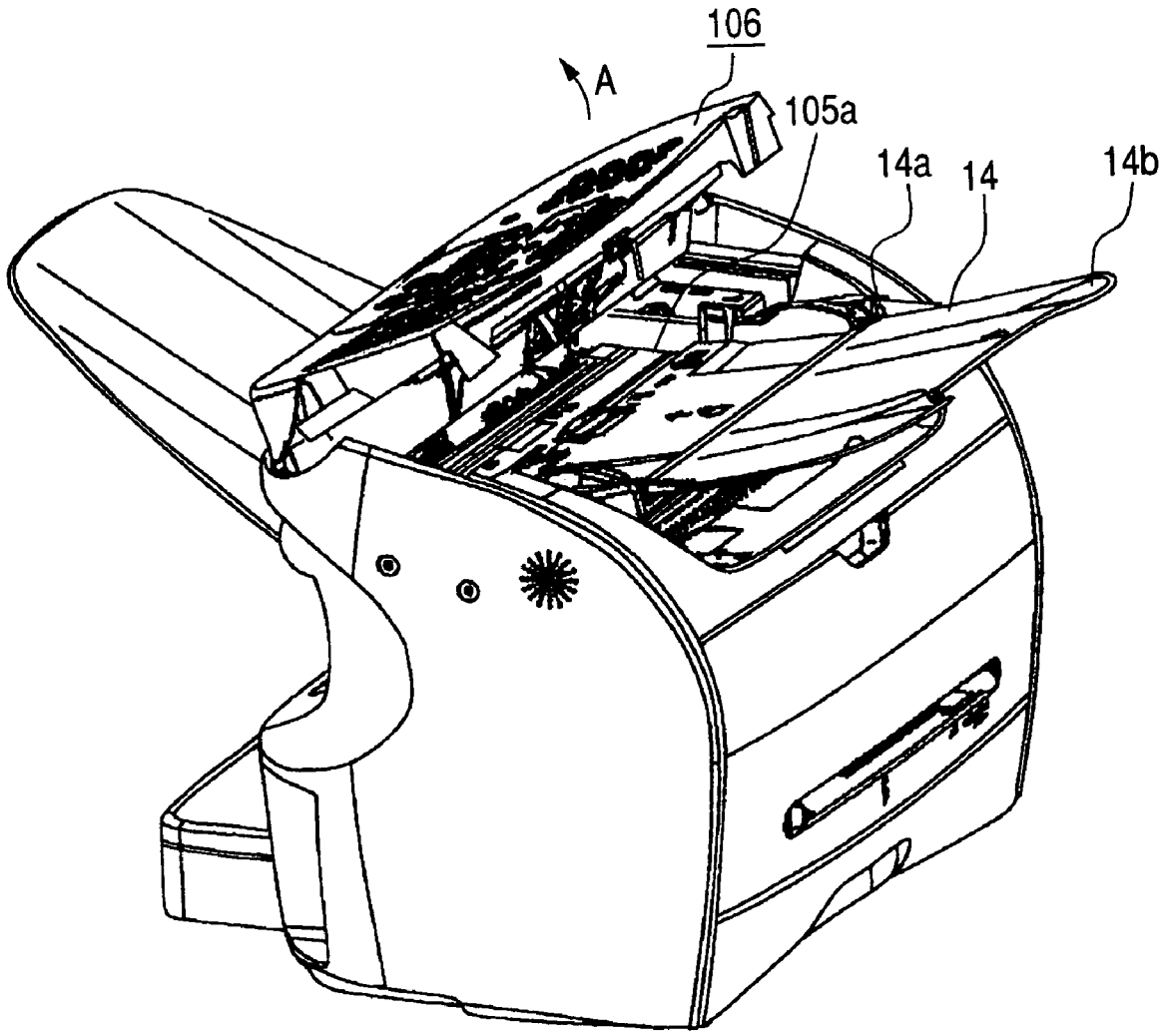
FIG. 6 is a perspective diagram showing the state that the operation portion of the MFP is opened.

Here, the upper original guide 1 is rotatably held based on a fulcrum 14*a* by the frame 11. Thus, when a jam occurs between a lower original guide 12*a* being the extension of the original tray 12 shown in FIG. 2 and the upper original guide 1, a jam process for releasing urging force of each roller is executed by rotating the upper original guide 1 in the direction indicated by an arrow A shown in FIG. 6.

Incidentally, metal parts, such as metal shafts 20*b* and 21*b* of the respective backup rollers 20*a* and 21*a* of FIG. 5 and the stainless blade springs 19*a* and 19*b* for urging the metal shafts 20*b* and 21*b*, which cause electrostatic noises are provided in the upper original guide 1. Thus, an earth plate 25 which acts as a grounded means is provided for grounding these metal parts.

Moreover, in the original reading section 105, a steel-plate original urging plate 24 (see FIG. 2) urges the original P toward the CIS 17 by using a helical compression spring 24*a*, and the bottom of the helical compression spring 24*a* is in contact with the earth plate 25 through the hole provided on the resin wall of the upper original guide 1. Furthermore, a charge eliminating brush (see FIG. 2) made by conductive fabric is provided in the discharging portion 103 so that the brush is in contact with the earth plate 25 through an opening portion 1*c* provided on the upper original guide 1.

Here, the earth plate 25 is fixed to the upper original guide 1 by screws together with the blade springs 19*a* and 19*b* and an earth lead 26 consisting of a coated lead and a round terminal, and the earth lead 26 is connected to the frame ground through the opening portion 1*c* provided in the vicinity of a rotational supporting portion 1*b* of the upper original guide 1.

Figure 4:
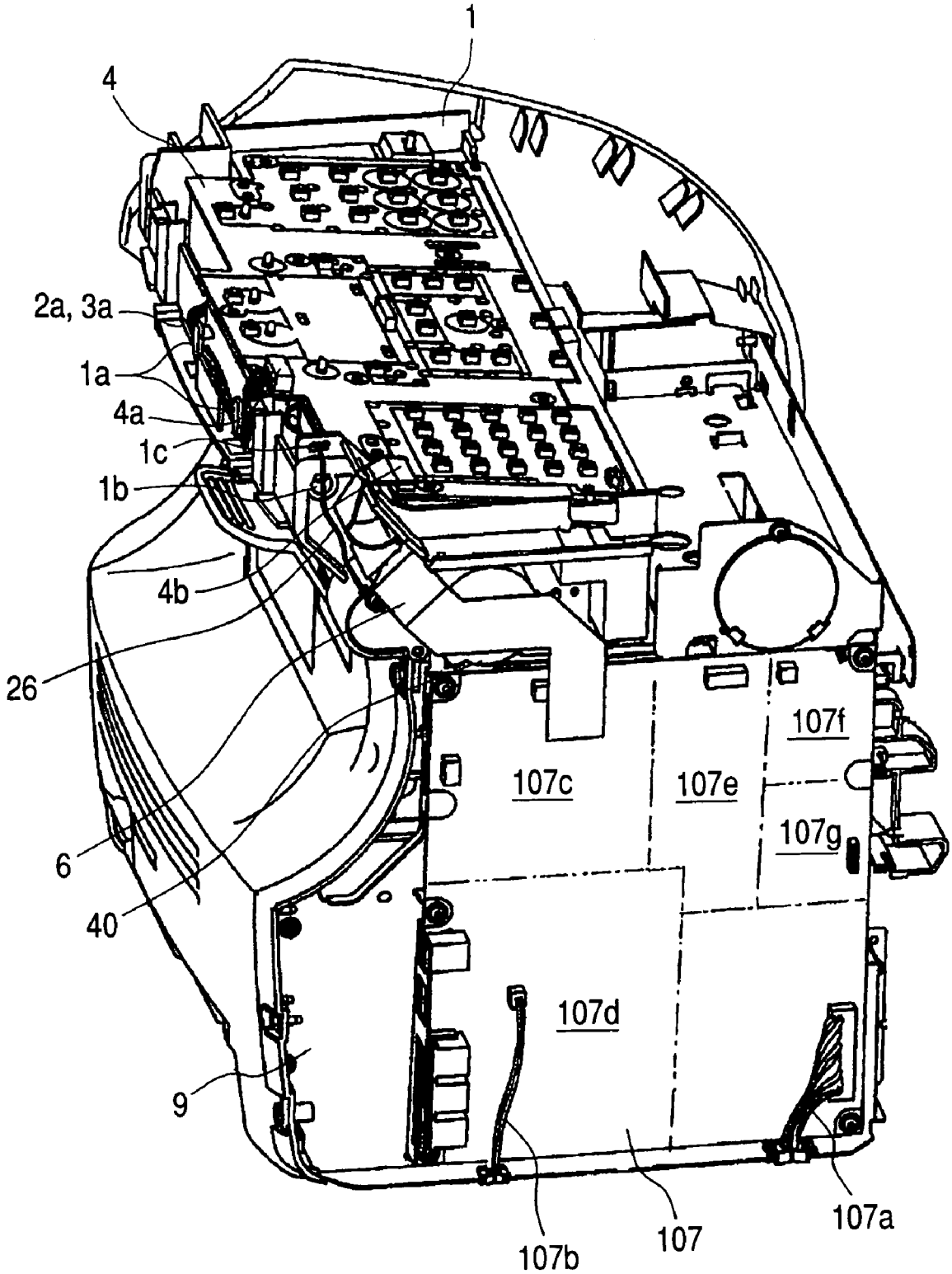
FIG. 4 is a perspective diagram for explaining the electrical component system of the MFP.

The operation portion 106, which is used by a user to issue various indications to the apparatus with respect to the four functions such as the copy function and the like of the MFP, is provided on the upper portion (upper original guide 1) of the original reading section 105. Incidentally, the operation portion 106 is connected to a main body control substrate 107 as shown in FIG. 4 by a flexible flat cable 6 through which power, a key matrix signal, an LCD signal and a sensor signal are transmitted.

Here, the position of the flexible flat cable 6 is fixed at the engaging portion provided on the frame 11 of the reading portion, and an elastic margin portion is provided between the engaging portion and the operation portion substrate 4. Thus, when the upper original guide 1 is opened to deal with the jam of the original P, the elastic margin portion of the flexible flat cable 6 can absorb positional shifting of a flat cable connector 4*b* on the operation portion substrate.

The main body control substrate 107, which is provided on the side face of the main body, includes an image processing portion 107*c*, a communication controlling portion 107*d*, a CPU 107*e*, a ROM 107*f* and a RAM 107*g*. Here, although not shown, a network connecting terminal, a telephone line connecting terminal, and a peripheral device connecting terminal (USB (Universal Serial Bus), IEEE (Institute of Electrical and Electronics Engineers) 1394 bus, a memory device, etc.) are provided on the communication controlling portion 107*d*. Thus, the relevant apparatus can function as a standalone apparatus or can function as a network device or a computer peripheral device. Incidentally, the main body control substrate 107 is connected to a power supply 104*a* and a recording control substrate 104*b* provided above the recording sheet cassette 7 through wiring harnesses 107*a* and 107*b*.

Figure 7:
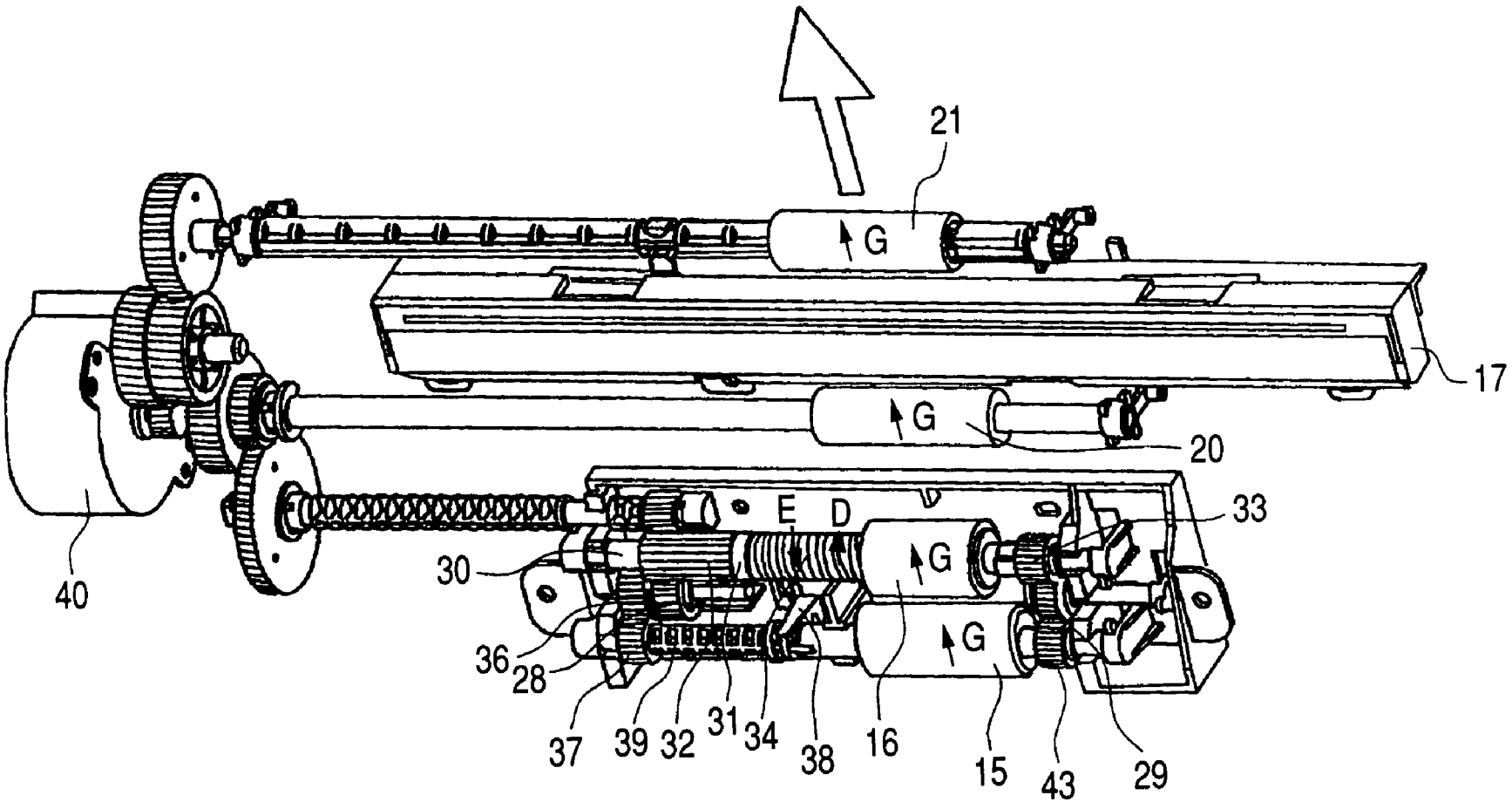
FIG. 7 is a diagram showing the detail of an original feeding portion provided on the MFP.

FIG. 7 is a diagram showing the detail of the original feeding portion. As shown in FIG. 7 and FIG. 5, the separating roller 16 acting as a sheet separating and conveying means to separate and convey the sheets one by one, a pre-feeding roller 15 acting as a sheet feeding rotation member (sheet feeding roller), a first idler gear 28, a second idler gear 29, the conveying roller 20, the discharging roller 21, the CIS 17, and a motor 40 acting as a normally and reversely rotatable driving means are attached to the frame 11.

Figure 8A:
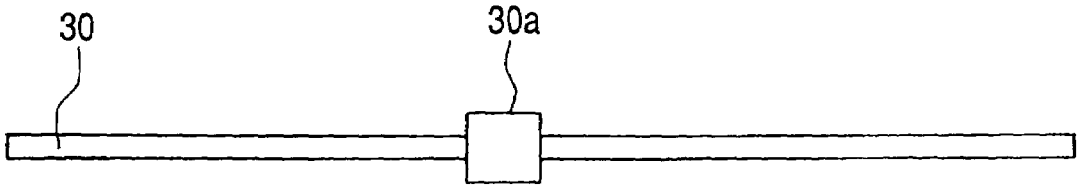
FIGS. 8A, 8B and 8C are diagrams showing a clutch spring and the like attached to a separating roller shaft provided in the original feeding portion.
Figure 8B:
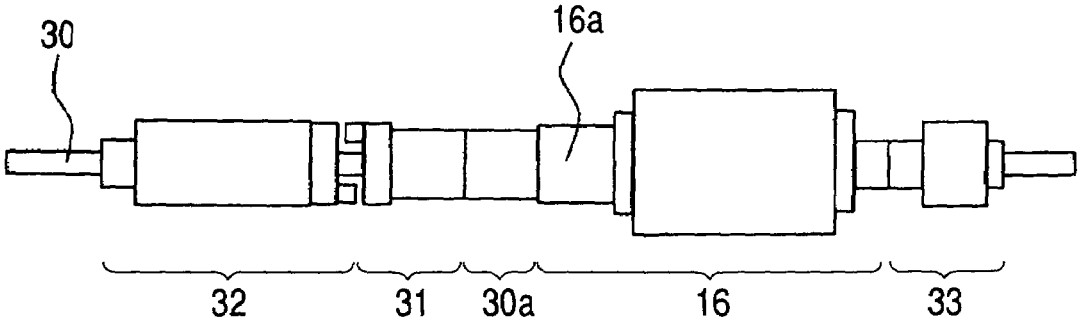

Here, as shown in FIG. 8A, a resin collar 30*a* is forcefully inserted by a separating roller shaft 30 to which the separating roller 16 is attached, whereby the resin collar 30*a* always rotates integrally with the separating roller shaft 30. Moreover, as shown in FIG. 8B, a mechanical timer 31 is rotatably provided on the driving input side (i.e., motor side) being one end of the separating roller shaft 30, and a separating driving gear 32 is inserted by the separating roller shaft 30. Incidentally, in the present embodiment, the mechanical timer 31 and the separating driving gear 32 are provided at the end of the separating roller shaft 30 with appropriate slacks (lashes or plays) in the rotative direction so as to delay transmission of the driving.

Moreover, the separating roller 16 is rotatably attached to the separating roller shaft 30 on the side opposite to the separating driving gear 32 across the resin collar 30*a*. Besides, an output gear 33 is fixed to the other end of the separating roller shaft 30, whereby the output gear 33 rotates integrally with the separating roller shaft 30.

Figure 8C:
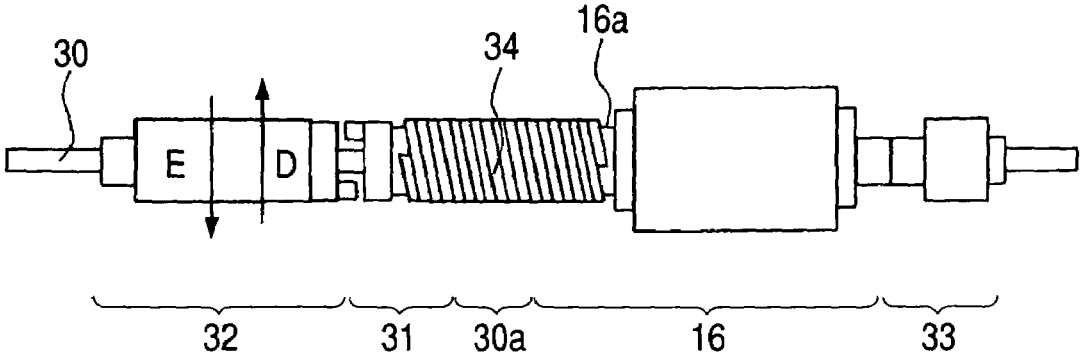

FIG. 8C shows the state that, after the mechanical timer 31, the separating roller 16 and the like were attached to the separating roller shaft 30, a clutch spring 34 is externally attached to the mechanical timer 31, the resin collar 30*a* and a sleeve 16*a* of the separating roller 16. Thus, the driving force of the separating driving gear 32 can be transmitted independently to each of the separating roller shaft 30 and the separating roller 16.

Incidentally, the resin collar 30*a* acts as a sheet feeding means driving force supplying portion which transmits the driving force from the motor 40 to the pre-feeding roller 15 through the clutch spring 34, and the sleeve 16*a* of the separating roller 16 acts as a sheet conveying means driving force supplying portion which transmits the driving force from the motor 40 to the separating roller 16.

Here, in the present embodiment, the winding direction of the clutch spring 34 being a clutch means is, for example, the winding direction so as to transmit the power to the output gear 33 and the separating roller 16 through the resin collar 30*a* and the sleeve 16*a* of the separating roller 16 when the separating driving gear 32 being a driving force supplying portion for supplying the driving force from the motor 40 is rotated in the direction indicated by an arrow D shown in FIG. 7 by the forward rotation of the motor 4.

Moreover, in the case where the separating driving gear 32 is driving also in the direction indicated by the arrow D, when the original P reaches the conveying roller 20 of which conveying speed is higher than that of the separating roller 16 as described later, there is a possibility that the separating roller 16 rotates faster than the separating driving gear 32 because compelling force is applied to the separating roller 16 through the original P due to a difference in rotational speed between the separating roller 16 and the conveying roller 20. In such a case, it is set that the clutch spring 34 loosens. Then, when the clutch spring 34 loosens, the driving force is not transmitted to the resin collar 30*a*, whereby the output gear 33 does not rotate.

Incidentally, when the clutch spring 34 loosens as above, the clutch spring 34 rotates according to the sleeve 16*a* of the separating roller 16 having the largest external diameter, and the mechanical timer 31 rotates according to the clutch spring 34 at rotational speed higher than that of the separating driving gear 32 due to loosening torque of the clutch spring 34. Here, when the mechanical timer 31 rotates faster than the separating driving gear 32 as above, the slack provided between the mechanical timer 31 and the separating driving gear 32 shifts toward the one side of the rotational direction, that is, the slack becomes small gradually in the rotational direction.

Then, when the mechanical timer 31 further rotates, the slack completely shifts toward the one side of the rotational direction, that is, the slack disappears. After then, because the loosening torque of the clutch spring 34 is minute, the rotational speed of the mechanical timer 31 comes to be substantially the same as that of the separating driving gear 32, and the state that the slack has shifted toward the one side of the rotational direction is maintained.

On one hand, after then, when the original P passed and thus the compelling force is not applied to the separating roller 16, the driving force is not transmitted from the separating driving gear 32 through the clutch spring 34 until the separating driving gear 32 rotates by the slack amount even if the separating driving gear 32 rotates, because the slack provided between the mechanical timer 31 and the separating driving gear 32 shifts toward the one side. Incidentally, when the separating driving gear 32 rotates reversely in the opposite direction indicated by an arrow E, the clutch spring 32 loosens, whereby the driving force is not transmitted to the resin collar 30*a*. For this reason, the driving force is not transmitted to the separating roller 16 and the output gear 33.

Meanwhile, the pre-feeding roller 15 is formed of a section D-cut shape having a notch portion 15A (see FIG. 5) formed by partially cutting the circumference face of the roller, a gear 43 to which the driving force is transmitted from the output gear 33 through the second idler gear 29 is provided at one end of a pre-feeding roller shaft 39, and a snaggletoothed gear 37 is provided at the other end thereof.

Here, it should be noted that the phase relation between the snaggletoothed portion of the snaggletoothed gear 37 and the notch portion 15A of the pre-feeding roller 15 satisfies that, when the snaggletoothed portion of the snaggletoothed gear 37 is at the position facing a shock absorbing gear (or buffer gear) 36, the notch portion 15A of the pre-feeding roller 15 is at its initial position which faces the original P stacked on the original tray 12 and does not project from the original tray 12.

When the rotation starts, the snaggletoothed gear 37 engages with the shock absorbing gear 36 being the intermediate gear. Here, the first tooth of the snaggletoothed gear 37 which first engages with the teeth of the shock absorbing gear 36 is made small so that the snaggletoothed gear 37 can easily engage with the shock absorbing gear 36. More specifically, the height of the first tooth of the snaggletoothed gear 37 is made low and the heights of the following teeth are made gradually large. Moreover, for example, the ends of the first to fourth teeth of the snaggletoothed gear 37 are made arc so that the snaggletoothed gear 37 can easily engage with the shock absorbing gear 36.

Furthermore, the ends of all the teeth of the shock absorbing gear 36 are made arc so that the shock absorbing gear 36 can easily engage with the snaggletoothed gear 37. Incidentally, it should be noted that such arc shape may be formed to at least one of the snaggletoothed gear 37 and shock absorbing gear 36.

Figure 9A:
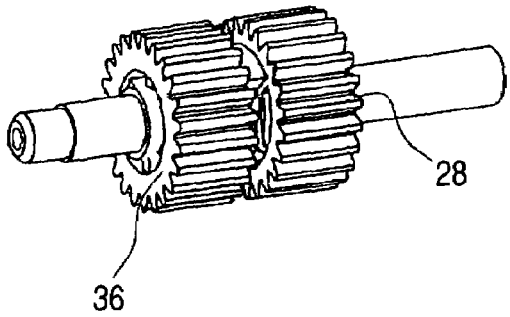
FIGS. 9A and 9B are diagrams for explaining the constructions of a shock absorbing gear, a first idler gear and the like provided in the original feeding portion.

The shock absorbing gear 36 and the first idler gear 28 being the transmitting gear engaging with the separating driving gear 32 are provided on the same shaft and thus constitute a train of gears as shown in FIG. 9A. Further, a delay portion is provided between the shock absorbing gear 36 and the first idler gear 28, whereby the driving force from the first idler gear 28 is transmitted to the shock absorbing gear 36 after delay.

Figure 9B:
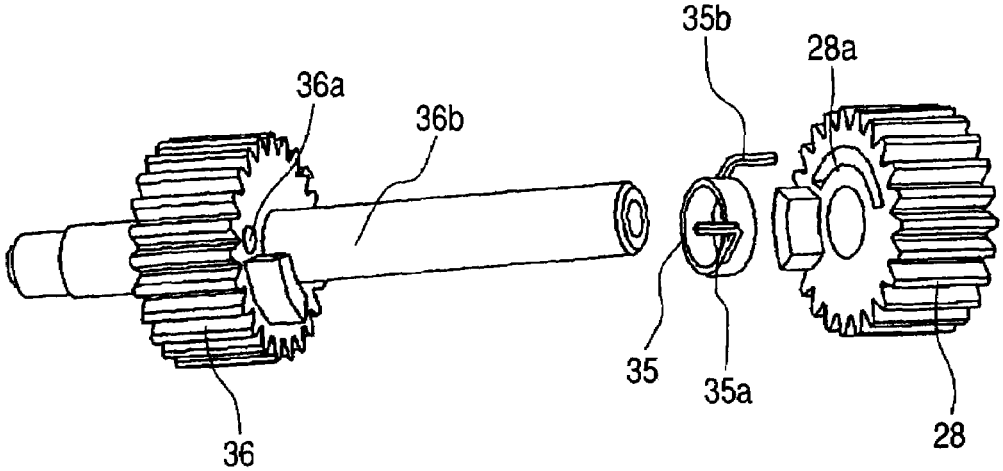

Incidentally, as shown in FIG. 9B, the delay portion consists of a shock absorbing spring 35 such as, e.g., a helical torsion spring, provided between the shock absorbing gear 36 and the first idler gear 28, a hole 36*a* provided on the shock absorbing gear 36, and an arc groove 28*a* provided on the first idler gear 28.

Then, when the first idler gear 28 rotates without any load in the direction according to the rotational direction D of the separating driving gear 32, that is, when the gears rotate in the state that the snaggletoothed gear 37 does not engage with the shock absorbing gear 36, the first idler gear 28 rotates by a predetermined amount, and the driving force is then transmitted from the first idler gear 28 to the shock absorbing gear 36 through the shock absorbing spring 35 which generates torque when the relative phase between the first idler gear 28 and the shock absorbing gear 36 comes to be equal or lower than a predetermined amount. Incidentally, it should be noted that the shock absorbing gear 36 rotates in any direction with respect to the first idler gear 28 according to deflection of the shock absorbing spring 35.

Figure 10:
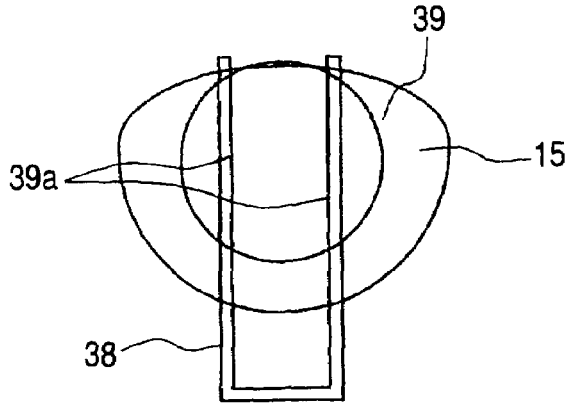
FIG. 10 is a diagram showing the aspect that a pre-feeding roller shaft is held tight by a rotation control spring provided in the original feeding portion.

Moreover, the pre-feeding roller 15 is held at its initial position by a rotation controlling spring 38 being a holding means shown in FIG. 7. In the present embodiment, the rotation controlling spring 38 holds the roller by holding tight two planes 39*a* provided on the pre-feeding roller shaft 39 as shown in FIG. 10.

Figure 11:
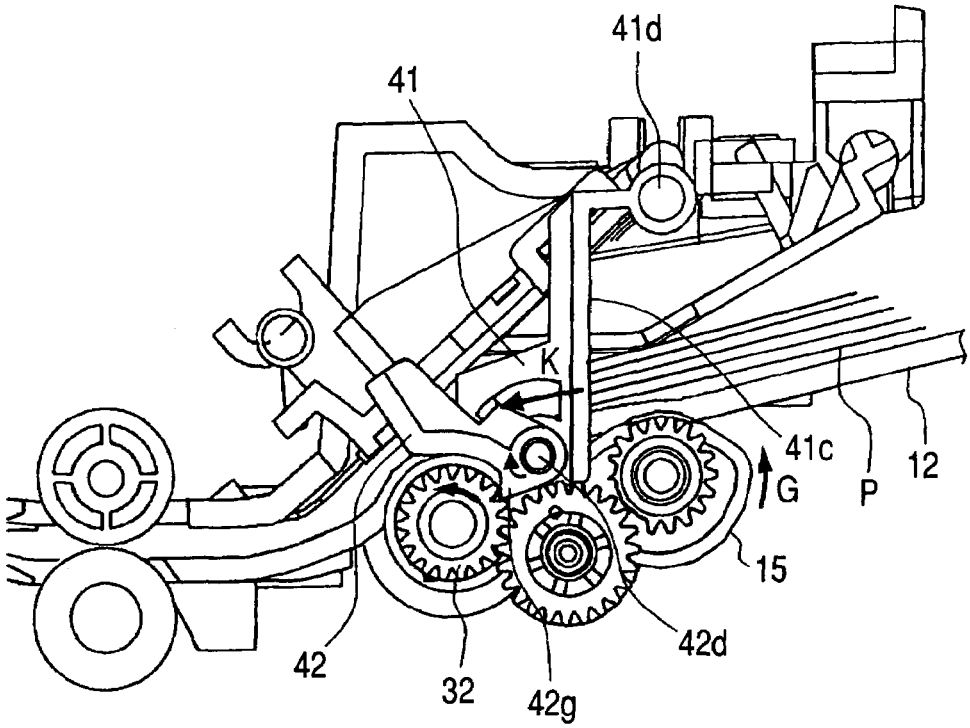
FIG. 11 is a diagram for explaining a stopper mechanism provided in the original feeding portion.

Incidentally, a stopper mechanism is provided in the original feeding portion to hold the original P at a predetermined position when the original P is inserted. As shown in FIG. 11, the stopper mechanism consists of a stopper member 41 acting as a stopper member of which upper end is rotatably supported based on a rotating shaft 41*d* as a fulcrum above the original tray 12 (original conveying face), and a pawl member 42 acting as a latch member (or locking member) which is rotatably provided based on a rotating center 42*d* as a fulcrum at the rotating end of the stopper member 41. Here, it should be noted that the stopper member 41 and the pawl member 42 constitute the stopper of the present invention.

Figure 12:
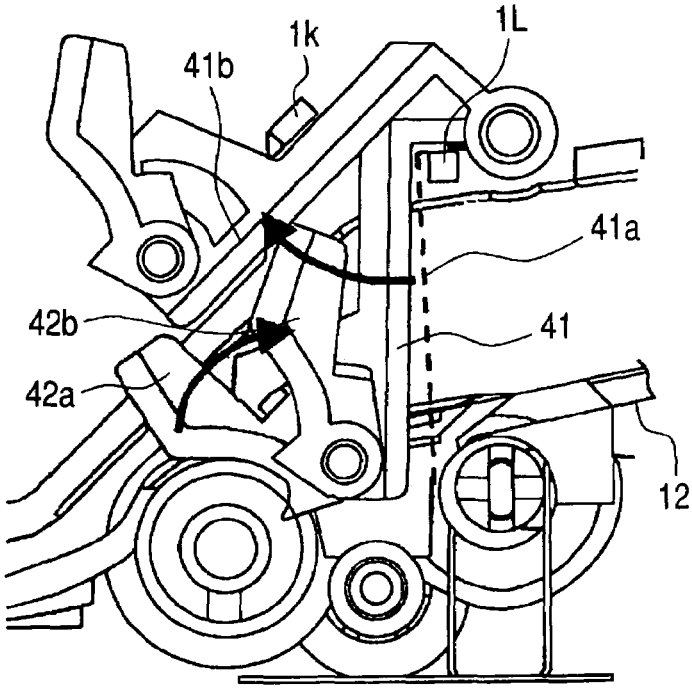
FIG. 12 is a first diagram for explaining the operation of the stopper mechanism.

Here, the stopper member 41 is rotated or turned from an initial position 41*a* which is denoted by the dashed line in FIG. 12 and restricted by a lower limit regulating portion 1L provided on the upper original guide 1 before the original P is stacked on the original stacking board 12 to an upper limit position 41*b* which is restricted by an upper regulating portion 1*k* provided on the upper original guide 1, and the pawl member 42 is rotated or turned from an initial position 42*a* to an upper limit position 42*b* with respect to the stopper member 41.

Incidentally, when the original P is stacked and inserted to the original stacking board 12 by an operator and the stopper member 41 is pressed by the stacked and inserted originals P in the direction indicated by an arrow K as shown in FIG. 11, the stopper member 41 is rotated or turned from the initial position to the position where a latch pawl 42*g* provided on the pawl member 42 engages with the root of the teeth of the separating driving gear 32 being the rotating member. Thus, the stopper member 41 enters the fixed state, whereby the stopper member 41 regulates the positions of the originals P so that the leading edges of the originals P are aligned with others at a predetermined position.

That is, when the stopper member 41 is rotated or turned from the initial position to the regulating position for regulating the original P to the predetermined position by the pressing of the original P stacked by the operator on the original stacking board 12, the stopper member 41 is held at the regulating position by a stopper holding means which consists of the pawl member 42 and the separating driving gear 32, whereby the leading edges of the originals P can be aligned and held at the predetermined position.

Moreover, as above, when the stopper member 41 is pressed by the original P and thus shifted from the initial position to the regulating position, the stopper member 41 is held at the regulating position by the stopper holding means. Thus, even if the original P is strongly pressed, the original P can be surely stopped at the predetermined position.

Figure 13A:
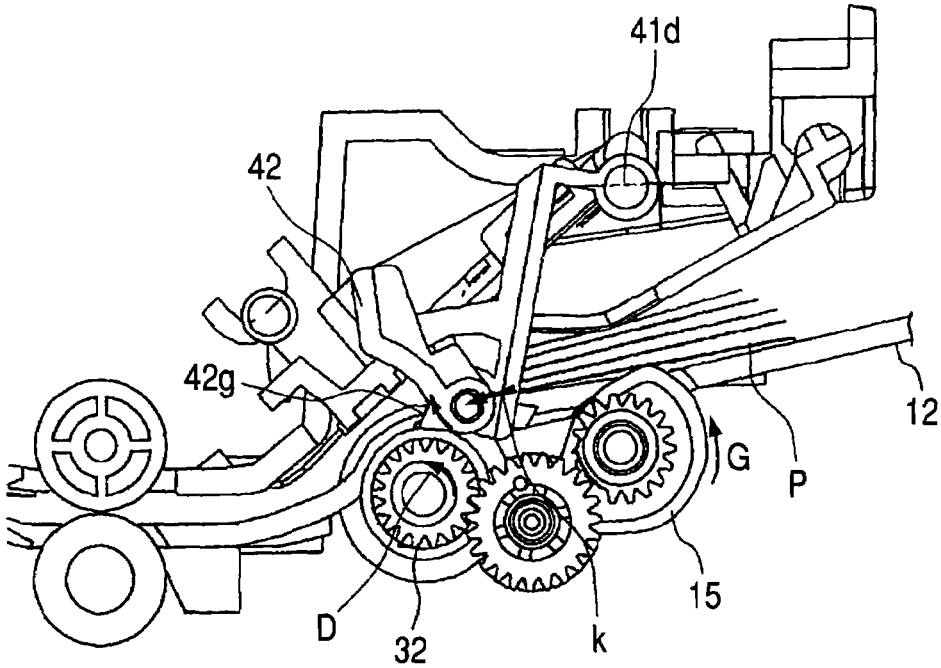
FIGS. 13A and 13B are second diagrams for explaining the operation of the stopper mechanism.

Meanwhile, when the original P is fed, if the separating driving gear 32 rotates in the direction indicated by the arrow D as shown in FIG. 13A, the pawl member 42 rotates in the direction indicated by the arrow in accordance with the rotation of the separating driving gear 32, whereby the latch state of the latch pawl 42*g* of the pawl member 42 and the separating driving gear 32 is released. Thus, the stopper member 41 can freely rotate based on the rotating shaft 41*d*.

Figure 13B:
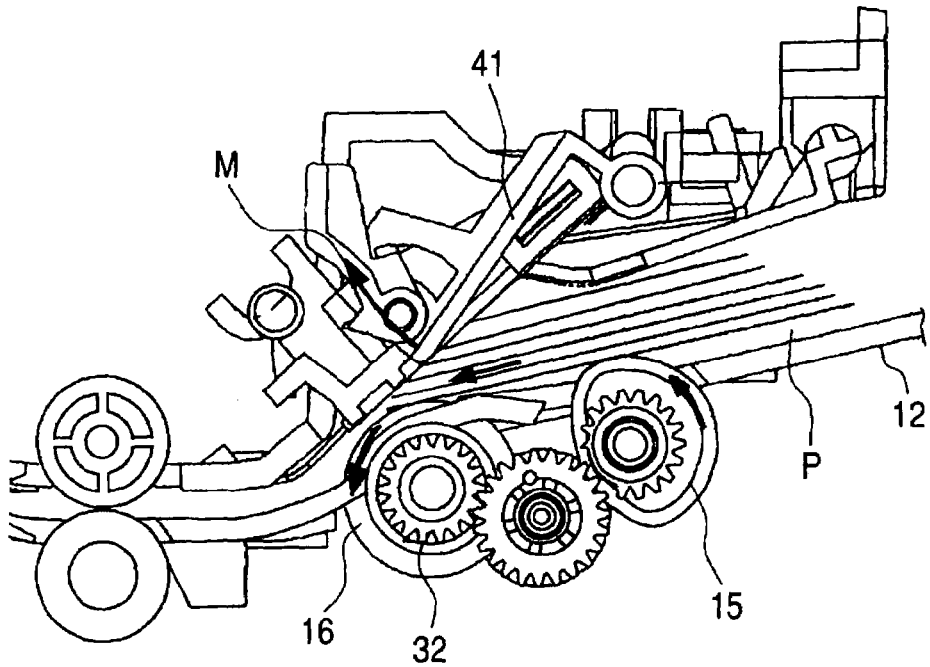

Under the circumstances, the pre-feeding roller 15 rotates in the direction indicated by an arrow G according to the rotation of the separating driving gear 32, and thus feeds the originals P from the lowest one on the original stacking board 12. Then, as shown in FIG. 13B, the stopper member 41 is pressed in the direction indicated by an arrow M by the original P fed by the pre-feeding roller 15, whereby the stopper member 41 rotates or turns to the position enabling to feed the original P. Incidentally, the fed original P advances in the arrow direction while pressing the stopper member 41, and then the original P is separated and conveyed one by one in the downstream direction by the separating roller 16 and the friction pad 22 (see FIG. 5).

Figure 14:
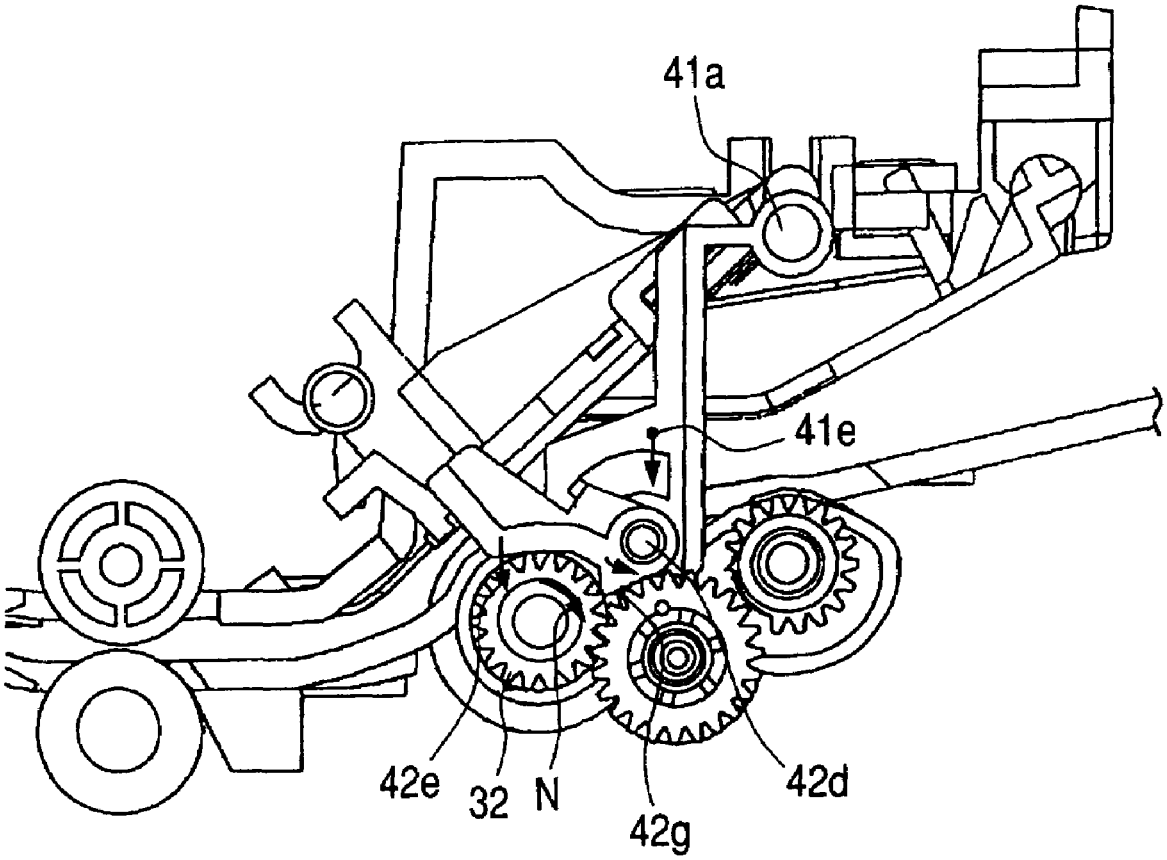
FIG. 14 is a third diagram for explaining the operation of the stopper mechanism.

Incidentally, as shown in FIG. 14, a barycenter 41*e* which is acquired by synthesizing the stopper member 41 and the pawl member 42 is provided on the separating driving gear side (i.e., downstream side in feeding direction) with respect to the rotating shaft 41*d* of the stopper member 41. That is, because the barycenter 41*e* acquired by the stopper member 41 and the pawl member 42 is provided on the downstream side in the feeding direction, when all the originals P are fed and thus there is no pressure by the original P, the stopper member 41 returns to the initial position 41*a* (see FIGS. 12 and 14) by the own weights of the stopper member 41 and the pawl member 42. Here, it should be noted that, in the present embodiment, the weight of the pawl member 42 is set to ½ or less of the weights of the stopper member 41.

In any case, after the stopper member 41 rotated or turned to the position which enables to feed the original P by the pressing of the fed original P, when the pressing by the original P is released, the stopper member 41 returns from the rotated position to the initial position, whereby it is possible to eliminate an initialization operation of the stopper member 41. Moreover, by eliminating the initialization operation of the stopper member 41 as above, it is possible to omit an electrical actuator, a spring clutch and the like, whereby it is possible to achieve space saving and cost reduction.

Besides, a barycenter 42*e* of the pawl member 42 is provided on the separating driving gear 32 side (i.e., downstream side in feeding direction) with respect to a rotating center 42*d* of the pawl member 42. Thus, the pawl member 42 can surely latch the latch pawl 42*g* between the teeth of the separating driving gear 32 by its own weight.

Incidentally, the pawl member 42 is constructed to return by its own weight to the position where the latch pawl 42 is not latched between the teeth of the separating driving gear 32 in the case where the stopper member 41 returns to the initial position. Thus, by such a construction, when the stopper member 41 returns to the initial position 41*a* or has returned to the initial position 41*a*, it is possible to prevent that the latch pawl 42*g* of the pawl member 42 engages with the separating driving gear 32 when the separating driving gear 32 rotates in the opposite direction (indicated by arrow N) to execute phase initialization of the pre-feeding roller 15 by the reverse rotation of the motor 40 as described later. As a result of this, it is possible to prevent that a load is applied from the pawl member 42 to the separating driving gear 32, whereby it is possible to smoothly rotate the separating driving gear 32.

Moreover, in a case where the upper original guide 1 is closed when the original P still remains on an original conveying path, the portions of the stopper member 41 and the pawl member 42 which first come into contact with the original P are set to be located on the downstream side of the rotating shaft 41*d* of the stopper member 41 in the original conveying direction. Consequently, even when the upper original guide 1 is closed, the stopper member 41 smoothly rotates so that the original P is not damaged.

Subsequently, an original feeding operation in the original feeding portion of the original reading section 105 will be explained.

First, when the plural originals P are inserted in the direction indicated by an arrow F of FIG. 2, the original presence/absence sensor 2 is turned on, and the leading edges of the inserted originals P then abut against the stopper member 41 as shown in FIG. 11.

Next, when a reading start indication is issued by the user from the operation portion 106 or from an external peripheral device, the motor 40 shown in FIG. 7 rotates forwardly. According to such forward rotation of the motor 40, the conveying roller 20 and the discharging roller 21 respectively rotate in the direction indicated by the arrow G and the separating driving gear 32 on the separating roller shaft 30 rotates in the direction indicated by the arrow D. Then, when the separating driving gear 32 rotates as above, the pawl member 42 of the stopper member 41 swings according to the rotation of the separating driving gear 32 as shown in FIG. 11, and the fixed (locking) state of the stopper member 41 is released, whereby the original P can advance toward the separating roller 16.

Moreover, when the separating driving gear 32 rotates as above, the clutch spring 34 shrinks and the driving in the conveying direction (arrow G direction) is thus transmitted to the separating roller 16, whereby the separating roller 16 rotates. At the same time, the driving is transmitted to the separating roller shaft 30 by the clutch spring 34 through the resin collar 30*a*, whereby the separating roller shaft 30 rotates.

Then, when the separating roller shaft 30 rotates as above, the driving is transmitted to the input gear 43 acting as the roller shaft gear of the pre-feeding roller 15 through the output gear 33 and the second idler gear 29 acting as the transmitting gear, whereby the pre-feeding roller 15 rotates in the conveying direction (arrow G direction).

That is, when the motor 40 rotates forwardly, the rotation (driving force) of the motor 40 is transmitted to the pre-feeding roller 15 by a first driving transmitting portion consisting of the separating roller shaft 30, the second idler gear 29 and the input gear 43 through the clutch spring 34, whereby the pre-feeding roller 15 rotates in the direction for feeding the original P.

Next, when the pre-feeding roller 15 rotates by a predetermined amount, the pre-feeding roller 15 comes into contact with the original P and starts to convey the original P. Moreover, according to the rotation of the pre-feeding roller 15, the snaggletoothed gear 37 engages with the shock absorbing gear 36. In this case, even if the snaggletoothed gear 37 and the shock absorbing gear 36 are not in phase, these gears smoothly engage with each other due to the shapes of the teeth thereof as described above.

Moreover, the phase difference between the snaggletoothed gear 37 and the shock absorbing gear 36 is absorbed according as the shock absorbing gear 36 having a slack (lash or play) with respect to the first idler gear 28 in the rotational direction rotates with respect to the first idler gear 28. Then, by constituting the snaggletoothed gear 37, the shock absorbing gear 36 and the first idler gear 28 as above, the snaggletoothed gear 37, the shock absorbing gear 36 and the first idler gear 28 can respectively rotate without preventing the separating driving gear from rotating even when the pre-feeding roller 15 rotates.

Next, the original P is fed by the rotation of the pre-feeding roller 15 as above, the fed original P is separated one by one by the separating roller 16 and the friction pad 22, and the separated original P is then transported to the conveying roller 20.

Incidentally, to prevent a jam and to make a gap between the current and subsequent originals P, the rotational speed of the conveying roller 20 is set higher than that of the separating roller 16. For this reason, when the conveying roller 20 starts to convey the original P, the separating roller 16 rotates at speed higher than that of the rotational speed of the separating driving gear 32 according to the conveying of the original P.

Here, when the separating roller 16 rotates at the higher speed than that of the rotational speed of the separating driving gear 32, the clutch spring 34 is loosened, whereby the shrinkage of the separating roller shaft 30 is released. Thus, the separating roller 16 rotates at the same speed as that of the conveying roller 20 without applying any load to the conveyed original P. Moreover, when the shrinkage of the separating roller shaft 30 by the clutch spring 34 is released, the driving force is hardly transmitted to the output gear 33, whereby the driving force is hardly transmitted to the pre-feeding roller 15 through the second idler gar 29.

Incidentally, even when the driving force is not transmitted through the second idler gear 29, the snaggletoothed gear 37 and the first idler gear 28 engaging with the separating driving gear 32 and thus rotating engage with each other through the shock absorbing gear 36, whereby the driving force is continuously transmitted to the pre-feeding roller 15 through these gears until the snaggletoothed portion of the snaggletoothed gear 37 comes to the position facing the shock absorbing gear 36. As a result of this, the pre-feeding roller 15 rotates up to the initial position where the roller does not project from a lower original conveying path. In this case, when the pre-feeding roller 15 comes to the position nearby the initial position, the rotation controlling spring 38 holds it, whereby the pre-feeding roller 15 stops just at the initial position.

That is, even when the driving force is not transmitted through the second idler gear 29, the rotation of the motor 40 is continuously transmitted to the pre-feeding roller 15 by a second driving transmitting portion consisting of the snaggletoothed gear 37, the first idler gear 28 and the shock absorbing gear 36. Thus, the pre-feeding roller 15 stops after it rotated up to the initial position.

Then, by stopping the pre-feeding roller 15 to the initial position as above, a released state is surely produced between the pre-feeding roller 15 and a pre-feeding pressing plate 44 when the original P is conveyed by the conveying roller 20, whereby it is possible to convey the original P without loading it, and there is no fear that disturbance of image occurs.

Subsequently, when the original edge sensor 3 (FIG. 2) detects the leading edge of the original P, the image information reading by the CIS 17 starts at predetermined timing, and the original P of which reading ended is then discharged by the discharging roller 21.

Incidentally, as described above, because the separating roller 16 rotates at high speed, the clutch spring 34 rotates according to the sleeve 16*a* of the separating roller 16. Thus, a slight idling torque occurs with respect to the resin collar 30*a* even when the pre-feeding roller 15 stops, whereby the slight driving is transmitted in practice to the pre-feeding roller 15 through the output gear 33 and the second idler gear 29. However, because the relation of ["the holding force of the rotation controlling spring 38" >>"the looseness torque of the clutch spring 34"] is satisfied, the pre-feeding roller 15 does not rotate.

Moreover, when the separating roller 16 rotates according to the original P at the speed higher than that of the separating rotating gear 32, the slack provided between the mechanical timer 31 and the separating driving gear 32 shifts toward the one side due to such a speed difference between the separating roller 16 and the separating driving gear 32, and such a situation is maintained. In this case, it should be noted that the speed difference is set so that the slack can sufficiently shift toward the one side while one original is passing.

Meanwhile, when the trailing edge of the original P passes the separating roller 16, the surrounding area of the separating roller 16 does not receive tensility. At that time, because the slack between the mechanical timer 31 and the separating driving gear 32 has shifted toward the one side, the separating roller 16 or the pre-feeding roller 15 does not rotate until the slack is consumed even when the separating driving gear 32 rotates in the D direction. Then, because a time of no sheet feeding is provided by inhibiting the pre-feeding roller 15 and the like from rotating, it is possible to control original reading intervals.

Subsequently, at the point that the slack provided between the separating gear 32 and the mechanical timer 31 is consumed, the clutch spring 34 again shrinks, whereby the separating roller 16 rotates based on the driving force transmitted from the separating driving gear 32. At the same time, the driving is transmitted to the separating roller shaft 30 through the resin collar 30*a*, and the driving is also transmitted again to the pre-feeding roller 15.

Incidentally, at that time, because the holding force of the rotation controlling spring 38 is sufficiently small with respect to the driving force of the pre-feeding roller 15 to which the driving is transmitted when the clutch spring 34 shrinks, the pre-feeding roller 15 can surely rotate.

After then, when the original presence/absence sensor 2 detects the next original P, the above operation is repeated to sequentially execute the image reading. Meanwhile, when the original presence/absence sensor 2 does not detect the next original P and the original edge sensor 3 detects the passing of the original P, a not-shown controlling means judges that the reading and discharging of the originals P ended and thus the sequential image reading wholly ended.

Incidentally, when it is judged based on the outputs from the original presence/absence sensor 2 and the original edge sensor 3 that the sequential image reading wholly ended, the controlling means causes the motor 40 to rotate reversely as the initializing operation to return the pre-feeding roller 15 to its initial position.

Then, as shown in FIG. 8C, by rotating reversely the motor 40 as above, the separating driving gear 32 rotates in the direction indicated by the arrow E, and the clutch spring 34 is loosened according to the rotation of the separating driving gear 32, whereby the transmission of the driving to the separating roller 16 and the separating roller shaft 30 is cut. As a result of this, the separating roller 16 does not rotate, and the transmission of the driving to the pre-feeding roller 15 through the second idler gear 29 is cut.

Here, when the pre-feeding roller 15 is not at the initial position, because the snaggletoothed gear 37 engages with the shock absorbing gear 36 as described above, the driving force is transmitted to the pre-feeding roller 15 through the first idler gear 28, the shock absorbing gear 36 and the snaggletoothed gear 37. As a result of this, the pre-feeding roller 15 rotates up to the position nearby the initial position, the rotation controlling spring 38 then holds it, whereby the pre-feeding roller 15 stops just at the initial position. Meanwhile, when the pre-feeding roller 15 is already at the initial position, the driving force is not transmitted to the pre-feeding roller 15, whereby the pre-feeding roller 15 does not rotate.

By the above operation, it is possible to initialize the pre-feeding roller 15, that is, to return the pre-feeding roller 15 to its initial position. By the way, the stopper member 41 automatically returns to its initial position due to its own weight when the original P on the stopper portion goes out of existence, whereby such an initializing operation as above is unnecessary.

As described above, when the motor 40 rotates forwardly, it is set to transmit the driving of the motor 40 to the pre-feeding roller 15 by using the clutch spring 34 through the first driving transmitting portion. On the other hand, when the motor 40 rotates reversely, it is set not to transmit the driving of the motor 40 to the pre-feeding roller 15 by using the clutch spring 34, and it is further set to transmit the driving force to the pre-feeding roller 15 by the second driving transmitting portion to shift the pre-feeding roller 15 to the initial position. Thus, it is possible to execute the driving force transmission and the stop position controlling with respect to the pre-feeding roller 15 by using the one clutch spring 34. Therefore, it is possible to achieve the driving force transmission and the stop position controlling of the pre-feeding roller 15 at low cost.

Subsequently, an interlock error preventing mechanism for the shock absorbing spring 35 provided between the shock absorbing gear 36 and the first idler gear 28 will be explained hereinafter.

As shown in above-described FIG. 9B, both the ends of the shock absorbing spring 35 are bent. On this occasion, in case of interlocking the shock absorbing spring 35, a shaft 36*b* of the shock absorbing gear 36 is first inserted into the shock absorbing spring 35, and one end 35*a* of the shock absorbing spring 35 is then inserted into the hole 36*a* provided on the shock absorbing gear 36. Subsequently, the shaft 36*b* of the shock absorbing gear 36 is rotatably inserted into the hole provided on the first idler gear 28, and the other end 35*b* of the shock absorbing spring 35 is inserted into the arc groove 28*a* provided on the first idler gear 28. Incidentally, it should be noted that the external diameter of the shock absorbing spring 35 is made smaller than the root circle of the gear so as to prevent teeth collision of the gear.

Here, in the present embodiment, the angle of the arc groove 28*a* of the first idler gear 28 is made larger than the rotational angle necessary for the mechanical timer. Thus, by setting the angle of the arc groove 28*a* within such a range, the shock absorbing spring 35 can move without any load.

Figure 15A:
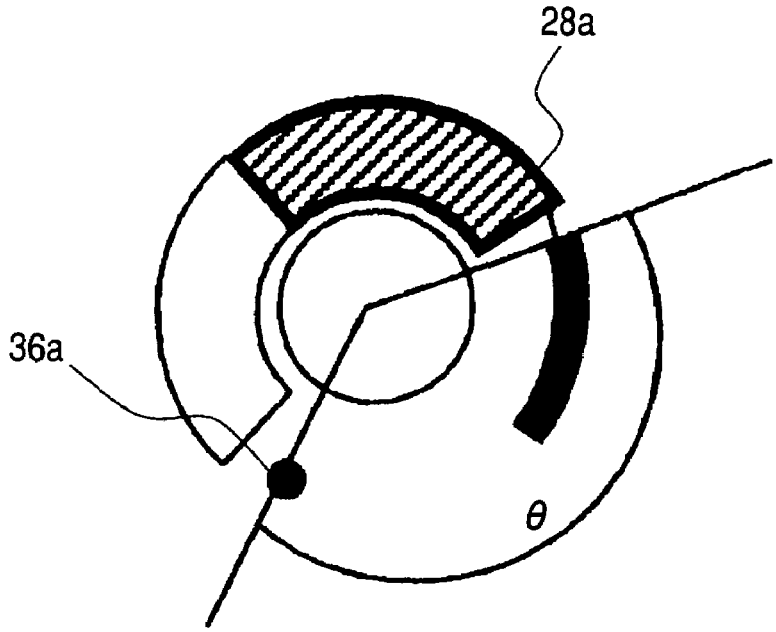
FIGS. 15A and 15B are diagrams for explaining an interlock error preventing mechanism for a shock absorbing spring provided between the shock absorbing gear and the first idler gear.
Figure 15B:
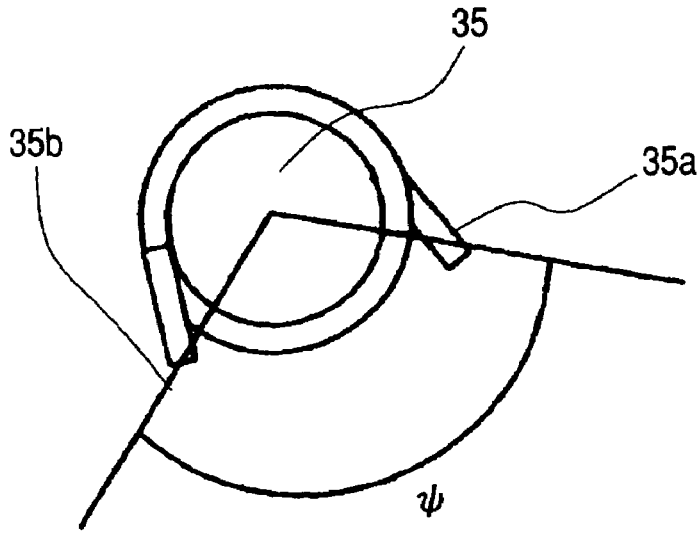

Moreover, if it is assumed that an angle $\theta$ made by the start point of the arc groove 28*a* and the hole 36*a* as shown in FIG. 15A and an angle $\Psi$ made by the two arms (i.e., both ends) of the shock absorbing spring 35 as shown in FIG. 15B satisfies $\theta<\Psi$, there is a possibility that the shock absorbing spring 35 is assembled reversely. In this case, the mechanical timer 31 does not effectively operate. For this reason, it is set that the angle $\theta$ and the angle $\Psi$ satisfies $\theta>\Psi$ so that the shock absorbing spring 35 is not interlocked reversely.

In addition, in the above-mentioned embodiments, the documents stacked on the document tray 12 are fed by the pre-feeding roller 15, and then the documents fed by the pre-feeding roller 15 are separated by the separating roller 16. However, it does not necessarily need not to provide pre-feeding roller 15. That is to say, it is possible to form an apparatus in which the documents stacked on the document tray are fed and separated by a separating roller. Incidentally, the above explanation is directed to the case where the sheet feeding apparatus according to the present invention is applied to the original feeding portion which conveys the original P to the original reading section 105. However, the present invention is not limited to this. That is, the present invention is also applicable to the recording sheet feeding portion 101 which supplies the recording sheet S to the image forming section 102.

As explained above, according to the present invention, the stopper is held by the gear at the regulating position of regulating the sheets, and the holding state of the stopper by the gear is released when the driving is transmitted to the gear. Thus, even if the sheet is strongly pressed, it is possible to surely stop the sheet at the predetermined position, and it is further possible to achieve space saving and cost reduction.

This application claims priority from Japanese Patent Application No. 2004-028279 filed on Feb. 4, 2004, which is hereby incorporated by reference herein.

What is claimed is:

1. A sheet feeding apparatus comprising:

a sheet stacking portion adapted to stack sheets thereon;

a sheet feeding rotating member adapted to feed the sheet stacked on said sheet stacking portion;

a stopper adapted to regulate the sheets stacked on said sheet stacking portion;

a rotatable gear adapted to hold said stopper at a regulating position of regulating the sheets stacked on said sheet stacking portion, by engaging with said stopper, and a driving unit configured to rotate said gear;

wherein the engagement of said gear and said stopper is released when said gear is rotated by the driving unit, said stopper has a stopper member which is rotatably supported, and a latch member rotatably supported on said stopper member, said latch member has a latch pawl which is latched between teeth of said gear, and said latch member rotates with respect to said stopper member while the latching of the latch pawl by said gear is being released, according to the rotation of said gear.

2. A sheet feeding apparatus according to claim 1, wherein rotational driving for rotating said sheet feeding rotating member is transmitted so that said gear rotates.

3. A sheet feeding apparatus according to claim 1, wherein said stopper is rotatably supported, said stopper rotates from an initial position preceding to the sheet stacking to the regulating position and held by said gear according as said stopper is pressed by the sheet stacked on said sheet stacking portion, after the hold of said stopper by said gear is released by rotating said gear, the sheet is fed by said sheet feeding rotating member, and when the feeding of the sheet by said sheet feeding rotating member is end, said stopper returns to the initial position.

4. A sheet feeding apparatus according to claim 3, wherein a barycenter of said stopper is located on a downstream side of a rotating shaft of said stopper in a sheet feeding direction.

5. A sheet feeding apparatus according to claim 1, wherein a barycenter of said latch member is located on a downstream side of a rotating shaft of said latch member in a sheet feeding direction.

6. A sheet feeding apparatus according to claim 1, further comprising a separating roller adapted to separate one by one the sheet fed by said sheet feeding rotating member, wherein said gear is provided on the same shaft as that of said separating roller, and wherein said sheet feeding rotating member feeds the sheet from the lowest sheet stacked on said sheet stacking portion.

7. A sheet feeding apparatus comprising:

a sheet tray;

a feeding rotary member which contacts with a sheet stacked on said sheet tray;

a rotatable stopper member located on a leading edge side of the sheet stacked on said sheet tray;

a latch member rotatably supported on said stopper member;

a holding member which holds said stopper member at a regulating position at which the stopper member regulates the sheets stacked on said sheet stacking portion, by engaging with said latch member; and a driving unit configured to move said holding member;

wherein said latch member rotates with respect to said stopper member while the engagement of the latch member and said holding member being released, according to the moving of said holding member.

8. A sheet feeding apparatus according to claim 7, wherein said hold member is a gear whose circumference face is provided with a plurality of teeth, and said latch member has a latch pawl which is latched between the teeth of said gear.

9. A sheet feeding apparatus according to claim 1, wherein said stopper member is rotatable about a rotation fulcrum provided above a conveying path on which a sheet is fed, and said gear is provided below the conveying path.

10. A sheet feeding apparatus according to claim 7, wherein said stopper member is rotatable about a rotation fulcrum provided above a conveying path on which a sheet is fed, and wherein said holding member is provided below said conveying path.

* * * * *

UNITED STATES PATENT AND TRADEMARK OFFICE

CERTIFICATE OF CORRECTION

PATENT NO. : 7,410,161 B2
APPLICATION NO. : 11/044290
DATED : August 12, 2008
INVENTOR(S) : Yamamoto It is certified that error appears in the above-identified patent and that said Letters Patent is hereby corrected as shown below:

ON THE COVER PAGE:
At Item (56), References Cited, Foreign Patent Document, line 1, "JP 58207228 12/1983" should read --JP 58-207228 12/1983--.
At Item (56), References Cited, U.S. Patent Documents, line 6, "2002/0008343 A1/2002 Inoue et al." should read --2002/0008348 A1/2002 Inoue et al.--.

COLUMN 1:
Line 58, "achieve" should be deleted.

COLUMN 8:
Line 23, "arc" should read --like an arc--.
Line 27, "arc" should read --like an arc--.

COLUMN 11:
Line 64, "speed" should read --a speed--.

COLUMN 12:
Line 9, "gar" should read --gear--.

COLUMN 14:
Line 48, "not" (second occurrence) should be deleted.

COLUMN 15:
Line 38, "end," should read --ended,--.

UNITED STATES PATENT AND TRADEMARK OFFICE

CERTIFICATE OF CORRECTION

PATENT NO. : 7,410,161 B2
APPLICATION NO. : 11/044290
DATED : August 12, 2008
INVENTOR(S) : Yamamoto It is certified that error appears in the above-identified patent and that said Letters Patent is hereby corrected as shown below:

COLUMN 16:
Line 3, "sheet fed" should read --sheets fed--.
Line 28, "hold" should read --holding--.

Signed and Sealed this

Thirtieth Day of December, 2008

JON W. DUDAS
*Director of the United States Patent and Trademark Office*